US009624866B2

(12) United States Patent
Pelizzoni et al.

(10) Patent No.: US 9,624,866 B2
(45) Date of Patent: Apr. 18, 2017

(54) METHOD OF ESTIMATING THE INJECTION PRESSURE OF AN INTERNAL COMBUSTION ENGINE

(71) Applicant: GM GLOBAL TECHNOLOGY OPERATIONS LLC, Detroit, MI (US)

(72) Inventors: Ivan Pelizzoni, Turin (IT); Luca Lauritano, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 303 days.

(21) Appl. No.: 14/459,030

(22) Filed: Aug. 13, 2014

(65) Prior Publication Data

US 2015/0051815 A1 Feb. 19, 2015

(30) Foreign Application Priority Data

Aug. 13, 2013 (GB) ..... 1314462.1

(51) Int. Cl.
*F02D 41/38* (2006.01)
*F02D 41/28* (2006.01)

(52) U.S. Cl.
CPC ..... *F02D 41/3809* (2013.01); *F02D 41/28* (2013.01); *F02D 2041/281* (2013.01); *F02D 2041/283* (2013.01); *F02D 2200/0602* (2013.01); *F02D 2200/0604* (2013.01)

(58) Field of Classification Search
CPC ..... F02D 41/24; F02D 41/2043; F02D 41/28; F02D 41/38; F02D 41/3809; F02D 2041/281; F02D 2041/283; F02D 2200/0602; F02D 2200/0604
See application file for complete search history.

(56) References Cited

U.S. PATENT DOCUMENTS 4,487,190 A * 12/1984 Isobe ..... F02D 41/107 123/492
4,951,647 A * 8/1990 Ezumi ..... F02D 41/04 123/480
5,533,492 A * 7/1996 Willey ..... F02D 41/0027 123/488
7,503,308 B2 * 3/2009 Kitagawa ..... F02D 37/02 123/325
2011/0166803 A1 7/2011 Koidl et al.

FOREIGN PATENT DOCUMENTS

WO 96/03577 A1 2/1996

* cited by examiner

*Primary Examiner* — Hieu T Vo
(74) *Attorney, Agent, or Firm* — Lorenz & Kopf, LLP

(57) ABSTRACT

A method of estimating an injection pressure for an internal combustion engine of an automotive system is disclosed that is well-suited for use with a digital pressure sensor, which periodically acquires injection pressure signals. An updated injection pressure value is calculated starting from an injection pressure signal and compensated with a pressure-correcting parameter, based on an elapsed time from the injection pressure signal acquisition, an actual engine speed and an actual fuel injection quantity.

11 Claims, 3 Drawing Sheets

METHOD OF ESTIMATING THE INJECTION PRESSURE OF AN INTERNAL COMBUSTION ENGINE

CROSS REFERENCE TO RELATED APPLICATION

This application claims priority to GB Patent Application No. 1314462.1 filed Aug. 13, 2013, which is incorporated herein by reference in its entirety.

TECHNICAL FIELD

The present disclosure relates to a method of estimating the injection pressure of an internal combustion engine, wherein a pressure signal is provided by a digital pressure sensor.

BACKGROUND

It is known that modern internal combustion engines are provided with a fuel injection system for directly injecting the fuel into the cylinders of the engine. As an example, the so called Common Rail System (CRS) is ubiquitous for Diesel Engines. The CRS, generally, includes a fuel pump, hydraulically connected to a fuel common rail and a plurality of electrically controlled fuel injectors, which are individually located in a respective cylinder of the engine and which are hydraulically connected to the fuel rail through dedicated injection pipes.

As also known, the injection pressure, which may reach values of about 200 MPa, is an important parameter for determining the quality of the fuel injection into the engine (for example, the fuel spray penetration in the cylinder head). Hence, any measurement or estimation of the injection pressure has to be accurate as much as possible. Currently, the injection pressure is measured by means of an analog pressure sensor, which is located on the common rail. Therefore, the terms "injection pressure" and "common rail pressure" are used synonymously in the present disclosure.

Recently, engine manufacturers are deciding to use a digital pressure sensor to measure the injection pressure, instead of the analog sensor. This solution will be compliant with the OBD2 requirements, common for both gasoline and diesel engines and will save one pin of the Electronic Control Unit (ECU).

The pressure measurements are managed by the ECU, using a time-based task (for example, 6.25 ms) for the pressure control and an angular-based task based on the engine crankshaft, triggered close to the first incoming injection, for the fuel injection control, in order to improve the fuel injected quantity accuracy. The angular-based task position is scheduled by the time-based task on an engine angular base. For engine angular base is meant that a time interval is replaced by the angle, the engine crankshaft has realized in the same time interval. Using the digital pressure sensor, the injection pressure sampling, which is time-based and is used for the injection control and, particularly, for the injector energizing time (ET) calculation function, happens inside a period in an unpredictable position with respect to the angular-based task. Being that the rail pressure behavior strongly affected by oscillations of its values, the unpredictable position penalizes the injection accuracy, increasing the injector quantity deviation.

Therefore a need exists for a method of estimating the injection pressure for an internal combustion engine, without the above inaccuracy, wherein the pressure signal is provided by a digital pressure sensor.

SUMMARY

In accordance with the present disclosure an injection pressure is estimated, wherein values are measured by a digital pressure sensor and the pressure value is accurately updated, taking into account the unpredictable position of the pressure measurements. Various embodiments provided by the present disclosure include a method, an apparatus, an engine, by an automotive system, a computer program and computer program product, and an electromagnetic signal.

For example, an embodiment of the disclosure provides a method of estimating an injection pressure for an internal combustion engine of an automotive system, provided with an ECU. The engine includes a fuel injection system, provided with a digital pressure sensor, which periodically acquires injection pressure signals. The method calculates an updated injection pressure value, starting from an injection pressure signal, and compensates the updated injection pressure value with a pressure correcting parameter, based on an elapsed time from the injection pressure signal acquisition, an actual engine speed and an actual fuel injection quantity. An apparatus is also disclosed for performing the method of estimating an injection pressure. The apparatus is configured to calculate an updated injection pressure value, starting from an injection pressure signal and compensate it with a pressure correcting parameter, based on an elapsed time from the injection pressure signal acquisition, an actual engine speed and an actual fuel injection quantity. Due to the fact that the digital pressure signal is not phased with the ECU angular-based task and the pressure value is needed just when the angular task is called, an advantage of these embodiments is the ability to update the pressure signal coming from the digital sensor in a very accurate way, by evaluating the elapsed time and knowing the pressure behavior as function of the engine speed and the fuel injection quantity.

According to a preferred embodiment, the elapsed time is calculated by setting an ECU internal counter to zero, when an ECU angular-based task is scheduled by the ECU and incrementing the ECU internal counter, until the ECU angular-based task is called by the ECU, while resetting the ECU internal counter to zero every time an injection pressure signal is acquired by the digital pressure sensor. Consequently the apparatus is configured to set an ECU internal counter to zero, when an ECU angular-based task is scheduled by the ECU, increment the ECU internal counter, until the angular-based task is called by the ECU and reset the ECU internal counter to zero every time an injection pressure signal is acquired by the digital pressure sensor. An advantage of this embodiment is that such ECU counter is defined to give a measure of the elapsed time from exactly the last injection pressure acquisition and the ECU angular task.

According to another embodiment, the pressure correcting parameter, when the ECU angular-based task is called from the ECU, is calculated from a calibrated map, whose input parameters are an actual engine speed, an actual fuel quantity and a value, which the ECU internal counter has assumed. Consequently, apparatus is configured to calculate the pressure correcting parameter, when the ECU angular-based task is called from the ECU, from a calibrated map, whose input parameters are an actual engine speed, an actual fuel quantity and a value, which the ECU internal counter has assumed. An advantage of this embodiment is to calculate a very accurate pressure correcting parameter, by using the ECU internal counter.

According to an aspect, the ECU internal counter is a time-based counter. An advantage of this aspect allows is that this is the easiest way to handle a counter inside the ECU, since it may be linked to the internal ECU clock.

According to another aspect, the internal counter is an angular-based counter. An advantage of this aspect is to have a more precise indication of the really elapsed time between the two events (i.e., from the injection pressure signal acquisition to the ECU angular task, when such pressure signal is read). In addition, this angular-based counter, being a new implementation in the ECU, can be refined as needed.

According to a further aspect of the disclosure, the pressure correcting parameter is an adding factor and the updated injection pressure value is calculated by algebraically summing the injection pressure signal and the adding factor. An advantage of this aspect is to have an easy solution for every engine application. The adding factor can be easily obtained for each engine application, by performing a simple test in steady-state conditions and observing the injection pressure behavior.

According to a still further aspect, the pressure correcting parameter is a multiplying factor and the updated injection pressure value is calculated by multiplying the injection pressure signal per the multiplying factor. An advantage of this aspect is to have a general factor that may be reusable in different engine applications, once the phenomenon has been observed. The multiplying factor can be the outcome of several tests in which the injection pressure behavior trend has been noticed for each engine application.

Another embodiment of the disclosure provides an internal combustion engine including a fuel injection system, provided with a digital pressure sensor wherein the injection pressure is estimated by a method according to one of the previous aspects. The method according to one of its aspects can be carried out with the help of a computer program including a program-code for carrying out all the steps of the method described above, and in the form of computer program product including the computer program. The computer program product can be embodied as a control apparatus for an internal combustion engine, including an Electronic Control Unit (ECU), a data carrier associated to the ECU, and the computer program stored in a data carrier, so that the control apparatus defines the embodiments described in the same way as the method. In this case, when the control apparatus executes the computer program all the steps of the method described above are carried out.

BRIEF DESCRIPTION OF THE DRAWINGS

The present disclosure will hereinafter be described in conjunction with the following drawing figures, wherein like numerals denote like elements.

DETAILED DESCRIPTION OF THE DRAWINGS

The following detailed description is merely exemplary in nature and is not intended to limit the present disclosure or the application and uses of the present disclosure. Furthermore, there is no intention to be bound by any theory presented in the preceding background or the following detailed description.

Figure 1:
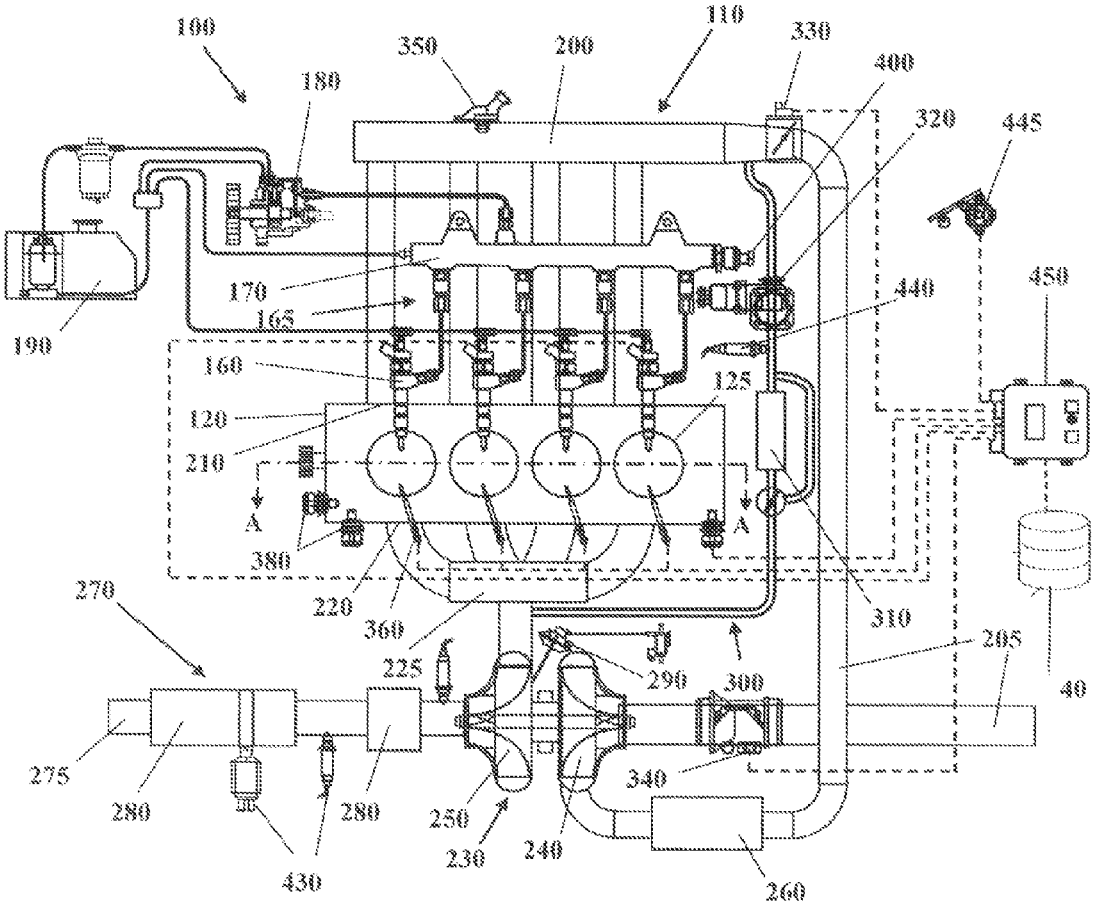
FIG. 1 shows an automotive system.
Figure 2:
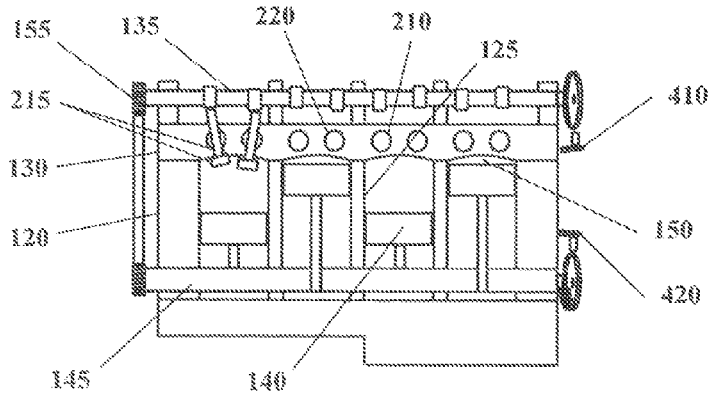
FIG. 2 is a section of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150.

A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. The fuel injection system with the above disclosed components is known as Common Rail Diesel Injection System (CR System). It is a relative new injection system for passenger cars. The main advantage of this injection system, compared to others, is that due to the high pressure in the system and the electromagnetically controlled injectors it is possible to inject the correct amounts of fuel at exactly the right moment. This implies lower fuel consumption and fewer emissions.

Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake ports 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after-treatment devices 280. The after-treatment devices may be any device configured to change the composition of the exhaust gases. Some examples of after-treatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110 and equipped with a data carrier 40. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor, which can be a digital pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

As mentioned, the ECU utilizes an ECU angular-based task, to control the closest incoming injection, which is scheduled by an ECU time-based task and calculated as follows. Starting from the following TDC (top dead center) position, the angular-based task is calculated by subtracting (all operations are in angles) the injection timing, a safety margin, the HWIO (hardware input-output) delay and the fuel calculation run time. Of course, to control the injection, the ECU angular-based task needs a reliable rail pressure value. Using the digital pressure sensor, the injection pressure sampling, used for the injection control and, particularly, for the injector energizing time (ET) calculation function, happens inside a period in an unpredictable position. Being that the rail pressure behavior is strongly affected by cyclical oscillations of its pressure value; the unpredictable position penalizes the injection accuracy, thereby increasing the injector quantity deviation.

Figure 3:
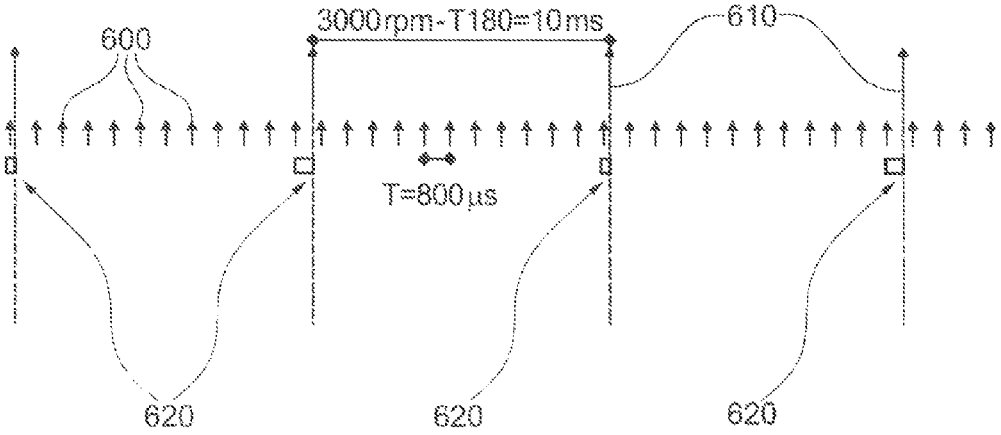
FIG. 3 is a graph depicting the digital pressure signal and the ECU angular-based task, highlighting the unpredictable reciprocal position.

FIG. 3 shows the digital pressure sensor signals 600 and the ECU angular-based tasks 610. The pressure value that the ECU would assume when the angular-based task is called is derived by the last pressure signal. As can be seen, if the distance between two angular-based tasks is not a multiple of the distance between two digital pressure sensor signals, the distance between the last pressure signal and the angular-based task is completely random. This behavior could generate an aliasing in rail pressure signal and in the fuel injected quantity.

Figure 4:
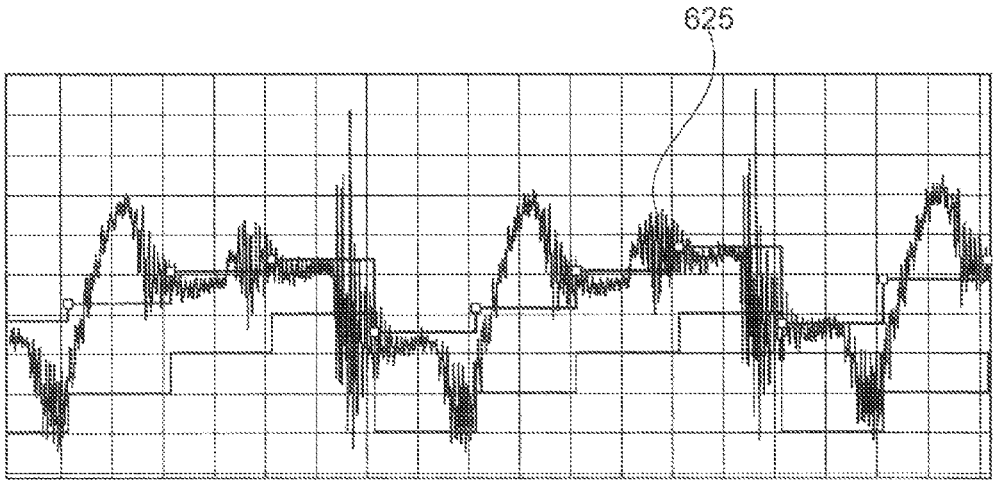
FIG. 4 shows the injection pressure behavior in steady-state conditions.

It has to be observed (see for example FIG. 4, showing an injection pressure behavior 625 vs. time in steady-state conditions) that the injection pressure behavior 625 is strongly variable, mainly due to pressure oscillations, caused by the dynamic of the physical phenomena: the effect of the incoming fuel, pumped by the injection pump, and the exiting fuel, injected by the fuel injectors. However, such pressure oscillations for a given engine operating condition (engine speed, fuel quantity) are almost repeatable in a time frame. This means, in other words, that knowing the pressure value at an initial condition (time- or angular-based) and a time or angular interval, it would be possible to estimate the pressure value at the end of such interval.

Figure 5:
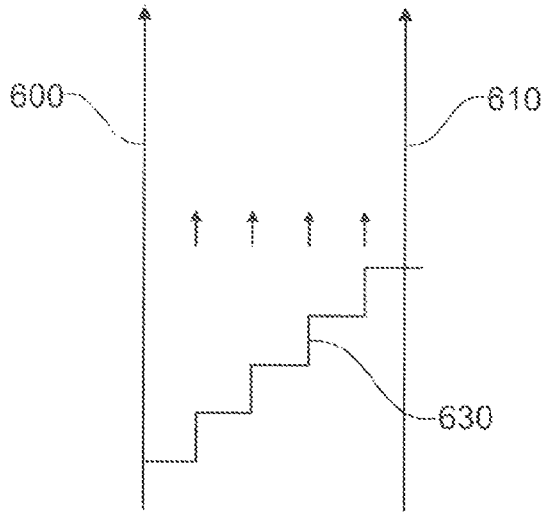
FIG. 5 schematized the counter which takes into account the time difference between the digital pressure signal and the ECU angular-based task.

The concept behind the present disclosure is therefore to update the acquired pressure value, as function of the engine operating conditions and taking into account the interval between the last pressure signal, provided by the digital pressure sensor, and the ECU angular-based task. In FIG. 5, an ECU internal counter 630 is defined and set to zero when the angular-based ECU task is scheduled and then incremented on a time or angular-based scale; the ECU internal counter is reset to zero whenever the digital rail pressure signal 600 is converted by the ECU. Finally, when the angular-based task is called, an updated rail pressure value is calculated starting from the pressure signal coming from the digital pressure sensor and modifying it with a correcting parameter taking into account the value the ECU internal counter has assumed and the engine working conditions.

Figure 6:
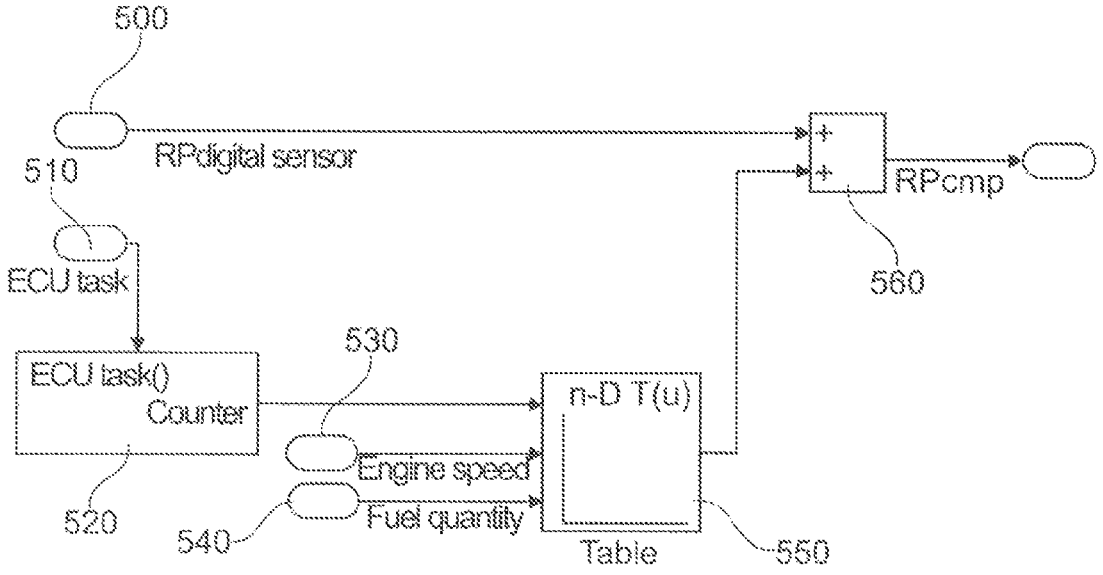
FIG. 6 is a block diagram illustrating the method of estimating the injection pressure according to the present disclosure.

FIG. 6 shows a block diagram illustrating the method. An injection pressure signal coming from the digital pressure sensor is periodically acquired 500. Then, as soon as the ECU angular-based task is scheduled 510 by the ECU, an ECU internal counter is set to zero and incremented 520 on a time-based scale or on an angular-based scale, until the angular-based task is called from the ECU. Whenever a new pressure signal is acquired, the ECU internal counter is reset to zero. Therefore, in particular, the counter will be reset to zero when the last pressure signal before the ECU angular-based task is acquired and then the ECU internal counter will be incremented until the ECU angular-based task is called by the ECU itself. At this moment, a pressure correcting parameter is calculated 550 from a calibrated map, whose input parameters are an engine speed 530, a fuel quantity 540 and the value the ECU internal counter has assumed. Finally, an updated injection pressure value is calculated 560 from the injection pressure signal and the pressure correcting parameter.

As mentioned, the ECU internal counter can be based on a time scale or an angular scale. In the first case, the implementation of this new strategy is very easy, since it is possible to link the ECU internal counter to the internal ECU clock, which is already available. In the second case the angular-based counter would be a new implementation in the ECU and consequently can be refined as needed, in order to have a more precise indication of the really elapsed time between the injection pressure signal acquisition and the ECU angular task.

According to the method, the pressure correcting parameter could be an adding factor and the updated injection pressure value is calculated by algebraically summing the injection pressure signal and the adding factor. It can be easily obtained for each engine application, by performing a simple test in steady-state conditions and observing the injection pressure behavior (for example, as the one shown in FIG. 4). Alternatively, the pressure correcting parameter is a multiplying factor and the updated injection pressure value is calculated by multiplying the injection pressure signal per the multiplying factor. The multiplying factor can be the outcome of several tests in which the injection pressure behavior trend has been noticed for each engine application, and, therefore, it may be reusable in different engine applications.

Summarizing, by using this method, the random effect of the distance between the pressure signal and the angular task is taken into account and the rail pressure used by the ECU to control the fuel injection is the most proper one.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. An internal combustion engine comprising a fuel injection system provided with a digital pressure sensor, the fuel injection system being operable to:

periodically acquire an injection pressure signal from the digital pressure sensor;

calculate an updated injection pressure value, starting from the injection pressure signal;

compensate the updated injection pressure value with a pressure correcting parameter, based on an elapsed time from the injection pressure signal acquisition, an actual engine speed and an actual fuel injection quantity; and control the fuel injection based on the compensated updated pressure value.

2. The internal combustion engine of claim 1 comprising a computer program including non-transitory computer-code.

3. The internal combustion engine of claim 2 comprising a memory on which the computer program is stored.

4. The internal combustion engine of claim 2 comprising a control apparatus having an electronic control unit, a data carrier associated to the electronic control unit and the computer program.

5. A method of estimating an injection pressure for an internal combustion engine having a fuel injection system with a digital pressure sensor which periodically acquires injection pressure signals, the method comprising:

calculating an updated injection pressure value, starting from an injection pressure signal;

compensating the updated injection pressure value with a pressure correcting parameter, based on an elapsed time from the injection pressure signal acquisition, an actual engine speed and an actual fuel injection quantity; and controlling the fuel injection based on the compensated updated pressure value.

6. The method according to claim 5, wherein said elapsed time is calculated by setting an internal counter to zero, when an angular-based task is scheduled, incrementing said internal counter, until said angular-based task is called, and resetting said internal counter to zero when an injection pressure signal is acquired by the digital pressure sensor.

7. The method according to claim 6, further comprising calculating said pressure correcting parameter from a calibrated map whose input parameters are an actual engine speed, an actual fuel quantity and a value assumed by said internal counter, wherein said calculation takes place when said angular-based task is called.

8. The method according to claim 6, wherein said internal counter is a time-based counter.

9. The method according to claim 5, wherein said internal counter is an angular-based counter.

10. The method according to claim 5, wherein said pressure correcting parameter is an adding factor and said updated injection pressure value is calculated by algebraically summing said injection pressure signal and said adding factor.

11. The method according to claim 5, wherein said pressure correcting parameter is a multiplying factor and said updated injection pressure value is calculated by multiplying said injection pressure signal and said multiplying factor.

* * * * *